United States Patent [19]

Brocklehurst

[11] Patent Number: 5,018,462

[45] Date of Patent: May 28, 1991

[54] EDGE FINISHING SYSTEM

[75] Inventor: Charles E. Brocklehurst, Fountain Inn, S.C.

[73] Assignee: Sew Simple Systems, Inc., Fountain Inn, S.C.

[21] Appl. No.: 421,981

[22] Filed: Oct. 16, 1989

[51] Int. Cl.[5] ..... D05B 21/00; D05B 1/20

[52] U.S. Cl. ..... 112/121.12; 112/121.15; 112/309; 112/262.3

[58] Field of Search ..... 112/121.11, 121.12, 112/121.15, 148, 153, 262.3, 269.1, 306, 308, 309, 320; 271/228, 234, 236, 239, 245, 248

[56] References Cited

U.S. PATENT DOCUMENTS

| | | | |
|---|---|---|---|
| 3,722,441 | 3/1973 | Kitchener et al. | 112/309 |
| 3,970,017 | 7/1976 | Babson et al. | 112/121.12 |
| 4,181,085 | 1/1980 | Conner, Jr. | 112/121.12 |
| 4,362,115 | 12/1982 | Rose et al. | 112/121.12 X |
| 4,434,730 | 3/1984 | Rose et al. | 112/121.12 |
| 4,601,249 | 7/1986 | Frye | 112/121.11 X |
| 4,608,936 | 9/1986 | Ball et al. | 112/121.12 |
| 4,685,408 | 8/1987 | Frye | 112/262.3 |
| 4,688,499 | 8/1987 | Moore et al. | 112/121.12 |
| 4,722,290 | 2/1988 | Manuel et al. | 112/153 |
| 4,776,579 | 10/1988 | Romand et al. | 112/121.12 X |

*Primary Examiner*—Werner H. Schroeder
*Assistant Examiner*—Paul C. Lewis
*Attorney, Agent, or Firm*—Thomas, Kerr & Kayden

[57] ABSTRACT

Transport plate (28) is moved downwardly into engagement with work product (25) and the plate (28) moves the work product to the edge finisher, such as sewing head (12) (FIG. 3). When the first edge (68) covers the first sensor (61), the transport plate (28) begins its movement from right to left (FIG. 4) so as to move the first edge (28) through the edge finisher, and the edge is finished as with an overedge stitch. When the second edge (69) uncovers the second sensor (62), the transport plate (28) rotates around an axis of rotation (75) (FIG. 5), causing the work product (25) to be rotated about the same axis of rotation (75) and the edge finisher forms the overedge stitch about the curved path until the second edge (69) covers first sensor (61), whereupon the linear right to left movement is resumed (FIG. 7).

19 Claims, 2 Drawing Sheets

EDGE FINISHING SYSTEM

BACKGROUND OF THE INVENTION

1. Field of the Invention

This invention relates to a method and apparatus for finishing the edges of a flat, sheet-like work product. More particularly, the invention relates to a system for sewing the edges of sheet material such as wash cloths, towels, napkins and other textile goods, by forming an over edge stitch around the perimeter edge of the product.

2. Description of the Related Art

In the production of flat textile goods, such as wash cloths, napkins and towels, it is desirable that the products be formed with edges that are not likely to fray or otherwise deteriorate with use, and so that the edges remain attractive during use. Some products are folded at their edges to form hems and the hems are sewn closed to hide the cut or ragged edge of the product, however, the edges of some products can be finished as by simultaneously trimming the edge and forming overedge stitches about the newly trimmed edge. This latter treatment is satisfactory for some wash cloths and napkins.

In the past, when the edges of flat textile goods were to be finished with an overedge stitch, the sewing machine operator would feed and guide the edges of the work product to the needle in the sewing machine. This requires the operator to turn the product when the needle of the sewing machine approaches a corner of the product, therefore requiring relatively high operator skill and concentration for high quantity production.

While some automated equipment has been developed for guiding edges of flat textile products to sewing machines for the purpose of finishing the edges of the products, the prior art guiding devices known to the inventor do not successfully control the flat work product so that the product can be turned when the sewing needle reaches the corner of the product and so that the sewing function can continue automatically to sew the next adjacent edge of the product. This is particularly so if the product should not be formed with right angle corners and straight edges.

SUMMARY OF THE INVENTION

Briefly described, the present invention comprises an edge finishing system adapted for finishing the edges of flat products, such as textile products, including wash cloths, napkins, towels and other flat goods, whereby the work product is automatically aligned with one of its edges positioned at a finisher such as a sewing machine, the product then is advanced so that its edges are finished by the sewing machine. The product is automatically turned as the corner of the product approaches the needle of the sewing machine so that the finishing process continues around the corner of the product and then commences along the next adjacent edge of the product.

The invention is disclosed as utilizing an overedge sewing machine with a cutter so that the edge of a wash cloth or other textile work product can be trimmed by the cutter as the overedge stitch is formed by the needles of the sewing machine. Obviously, other edge finishing apparatus can be utilized and other work products can be finished by the edge finishing apparatus.

The control mechanism used to form and orient the work product comprises a cutter for cutting segments from a continuous supply of the goods that form the work product, and a detection and control system whereby an edge of the work product is advanced along a path through the finishing apparatus, the work product is turned when a corner approaches the finishing apparatus and the next adjacent edge of the work product is advanced along the path through the finishing apparatus. The system operates so that it will properly finish the edges of nonuniform work products, such as wash cloths and napkins that are formed with nonrectilinear edges and with corners that are not formed at right angles.

Photocells or other sensing devices are used to detect the presence of the perimeter edges of the work product as those edges approach the sewing station so as to begin the turning of the work product about a predetermined axis located at a known distance from the sewing station so as to form a radius about the corner of the work product.

Thus, it is an object of this invention to provide an automated edge finishing system which functions expediently and efficiently to finish the edges of flat work product such as textile goods.

Another object of this invention is to provide an improved control system for controlling the movement of flat textile goods at a sewing machine so that the goods can be manipulated during the sewing function so that the edges of the goods are properly finished.

Another object of this invention is to provide an automated control system which can be used in conjunction with an edge finishing device, such as a sewing machine, whereby a flat work product, such as flat textile goods, can be maneuvered so as to guide the edges of the work product to the needle of the sewing machine and the sewing machine can thereby finish the edges of the work product.

Other objects, features and advantages of the present invention will become apparent upon reading the following specification, when taken in conjunction with the accompanying drawings.

DETAILED DESCRIPTION

Figure 1:
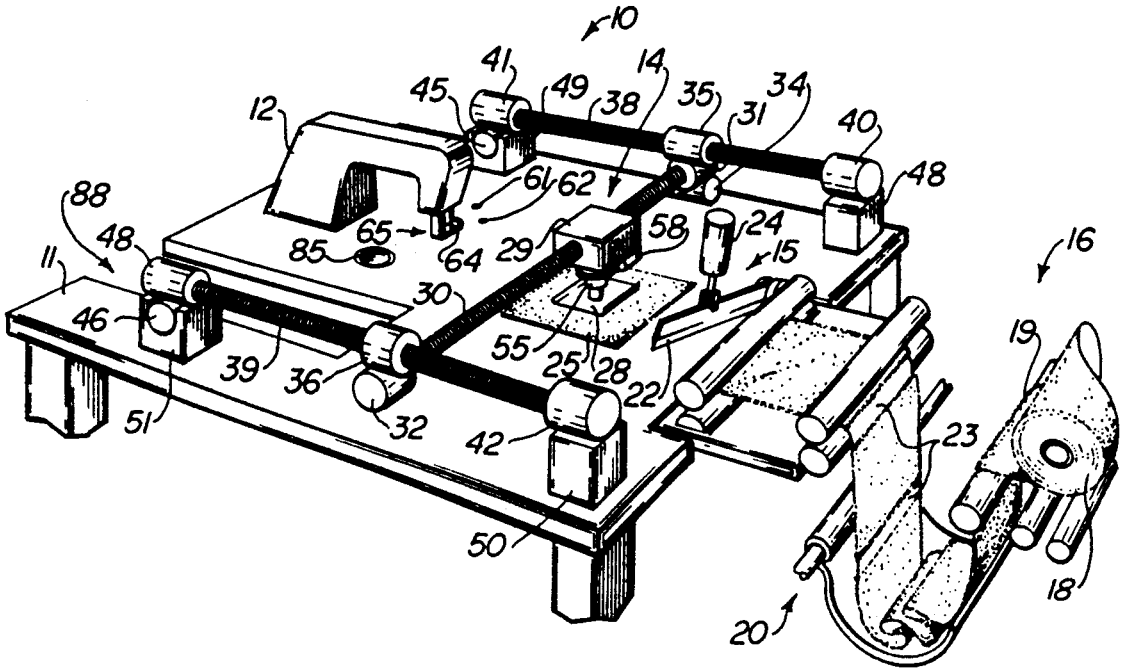
FIG. 1 is a perspective illustration of the edge finishing system.

Referring now in more detail to the drawings, in which like numerals indicate like parts throughout the several views, FIG. 1 illustrates edge finisher 10 that includes a substantially flat work table 11, sewing head 12, and work product control system 14. Cutting mechanism 15 and the feed system 16 move the work sheet material toward the edge finisher 10.

Feed system 16 supports a reel 18 of a continuous supply of the sheet material 19, such as terry cloth. The free end of the sheet material from the reel is moved through a conventional feed control 20 to the cutting mechanism 15. The cutting mechanism 15 includes a cutting blade 22 that is pivoted at one end and reciprocated by cylinder 24 so as to engage with a scissors-like action a cooperative cutting edge (not shown) located beneath the path of movement of the sheet material 19. If the sheet material is terry cloth, it is common that blank spaces 23 are formed across the material where the plush material is absent. This blank space is where the cutting blade 22 usually cuts across the sheet material. Suitable detecting apparatus (not shown) can be used to detect the blank spaces 23 in the terry cloth and to straighten those blank places, if necessary. The detecting and straightening apparatus can be of the type disclosed in U.S. Pat. No. 4,595,133.

Once a segment 25 of the sheet material has been cut from the free end of the reel 18, the segment or "work product" can be moved to sewing head 12 for finishing of the perimeter edges of the segment. Edge finisher 10 includes a transport plate 28 that moves downwardly into flat engagement with segment 25. The facing surface of transport plate 28 includes a soft surface (not shown) that engages the upper surface of segment 25 so that a relatively firm gripping force is applied by the transport plate to the segment. On the lower side of the segment 15 the flat work table is relatively smooth and offers little resistance to sliding movement of the segment 25. This enables the transport plate to move downwardly into engagement with the segment 25 and then move laterally across the work table 11 in "X" and "Y" directions and therefore transport the segment about the work table.

Figure 2:
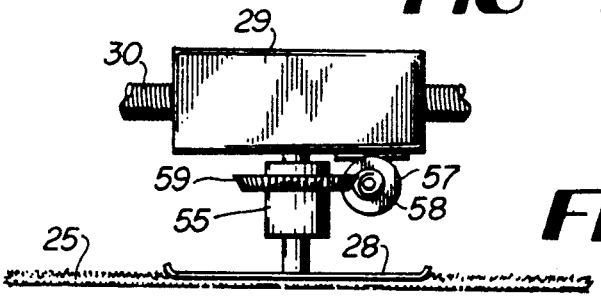
FIG. 2 is a side elevational view of the transport plate, its cylinder, motor and travel head.

As illustrated in FIGS. 1 and 2, work product control system 14 includes a travel head 29 mounted on transverse travel screw 30, with the ends of travel screw 30 being mounted in bearings 31 and 32. Reversible motor 34 is mounted to bearing 31 and functions to rotate travel screw 30. The motor 34 and its bearing 31 are mounted to perimeter travel block 35, whereas at the other end of travel screw 30 bearing 32 is mounted to perimeter travel block 36. Travel blocks 35 and 36 are mounted on perimeter travel screws 38 and 39. The travel screws 38 and 39 are mounted on end bearings 40, 41, and 42, 43, respectively. Reversible motors 45 and 46 engage travel screws 38 and 39, respectively, so as to impart rotary motion to the travel screws. Suitable mounting posts 48–51 support the work product control system 14 from the upper surface of the work table 11, so that the elements of the work product control system 14 are suspended above the work table.

As illustrated in FIG. 2, expandable cylinder 55 extends between travel head 29 and transport plate 28. When cylinder 55 is contracted, transport plate 28 is lifted upwardly away from the work table 11 so as to separate the transport plate 28 from the work product 25, and when the cylinder 55 is extended, the transport plate 28 moves toward the work table and toward the work product 25 so as to frictionally engage the work product.

Electric motor 57 is mounted to the lower portion of travel head 29 and its beveled sprocket 58 engages bevelled ring gear 59 which is mounted about cylinder 55. Cylinder 55 is rotatably mounted to travel head 29 so that the cylinder 55 and its transport plate 28 can rotate about a vertical axis.

A pair of sensing devices, such as photocells 61 and 62, are located adjacent sewing head 12. The photocells 61 and 62 are illustrated as being recessed in the surface of the work table 11; however, the photocells can be suspended over the work table, if desired. The photocells 61 and 62 are located adjacent the sewing needle 64 of the sewing head 12, with the pointed end 65 of the needle 64 and the associated presser foot, feed dogs, etc. comprising the sewing station 65 of the system. The sewing path 67 extends from right to left through the sewing station 65.

OPERATION

When the edge finishing system is placed in operation, the feed system 16 (FIG. 1) feeds out the free end of the supply of the terry cloth or other sheet material 19, and cutting mechanism 15 cuts across the free end of the sheet material so as to separate a segment 25 from reel 18. A computer control system (not shown) operates to rotate travel screws 30, 38 and 39 so as to bring the transport plate 28 over the cut segment 25 with the transport plate raised above the work table 11. When the transport plate 28 has become positioned over the segment 25 (FIG. 2), cylinder 55 lowers the transport plate down into engagement with the segment 25.

Figure 3:
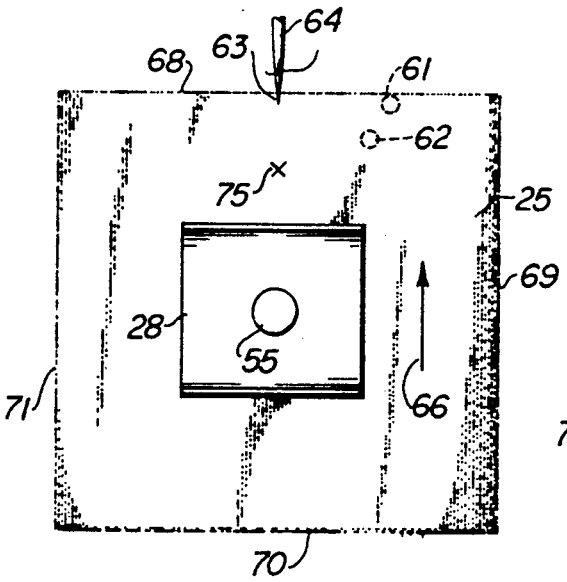
FIGS. 3–9 are schematic plan views of a rectangular work product as it is manipulated adjacent the sewing station, showing how the work product is moved so that its edges move through the sewing station and then how the work product is turned as the next adjacent edge approaches the sewing station.
Figure 4:
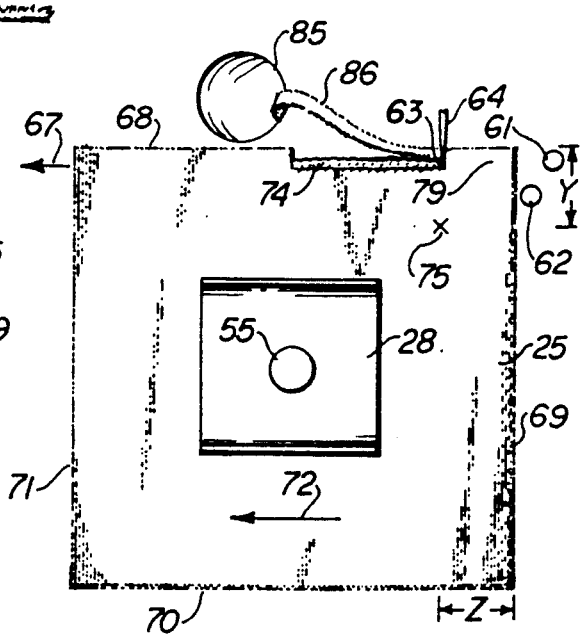
Figure 5:
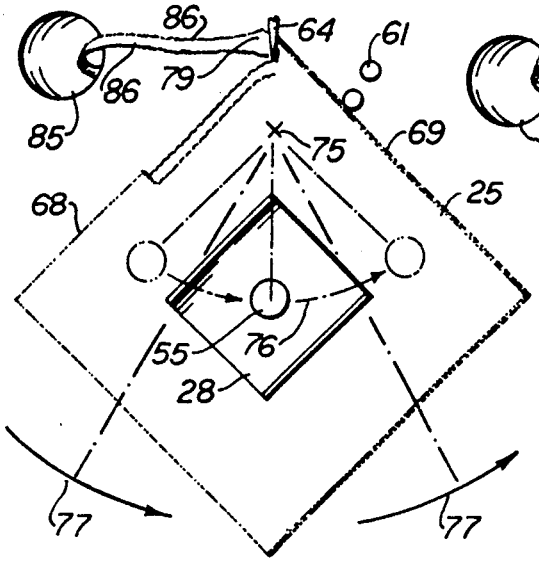

As illustrated in FIG. 3 of the drawings, the transport plate 28 moves the cut segment 25 toward sewing station 65. The direction of movement is indicated by arrow 66; however, the direction of movement of the transport plate 28 and segment 25 can vary as may be necessary.

When the first edge 68 of the segment 25 moves beneath the needle 64 of the sewing head and through the sewing station 65, the first edge of the segment will also cover photocell 61. When photocell 61 senses the leading edge 68 of the segment 25, the movement of the segment 25 in the direction as indicated by arrow 66 terminates. In the meantime, if the segment 25 is a perfect rectangle, the other edges 69, 70 and 71 of the segment 25 will be formed at right angles with respect to each other about the work product, as illustrated.

Once the photocell 61 has been covered by the segment 25, the work product control system 14 will operate to move the transport plate 28 and segment 25 to the left (FIG. 4) as shown by arrow 72, so that the first edge 68 of the segment is moved along a sewing path 67 and through the sewing station 65 and is progressively trimmed and sewn by the sewing head 12, with the needle 64 of the sewing head 12 being illustrated in FIGS. 3–10. The sewing head 12 is an overedge stitching machine and an overedge stitch 74 is progressively formed about the edge portion of the segment 25.

When the segment 25 uncovers second photocell 62, this is an indication that the next adjacent edge 69 is approaching the sewing station 65 and the segment 25 must be turned so that the sewing needle 64 will not sew off the segment. In response to the photocell 62 detecting the adjacent edge 69, the work product control system 14 begins to rotate the work product 25 about an axis of rotation 75. The axis of rotation 75 is located at a distance Y from the first edge 68 which is equal to the distance Z from the axis of rotation 75 to the second edge 69.

In response to the detection of the second oncoming edge 69 by the photocell 62, transport plate 28 will rotate about the axis of rotation 75. This causes the entire segment 25 to rotate counterclockwise about axis 75, as illustrated by the arrows 76 and 77 of FIG. 5. During the rotation the right angle corner 79 will be trimmed off of the work product as the trimming and sewing function continues to be performed by the sewing head.

Figure 6:
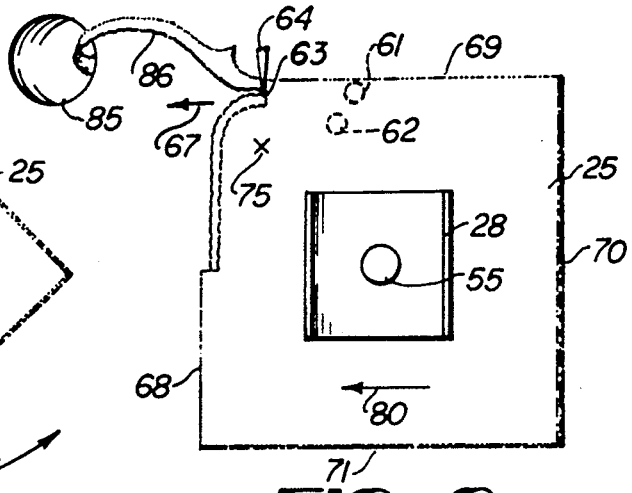
Figure 7:
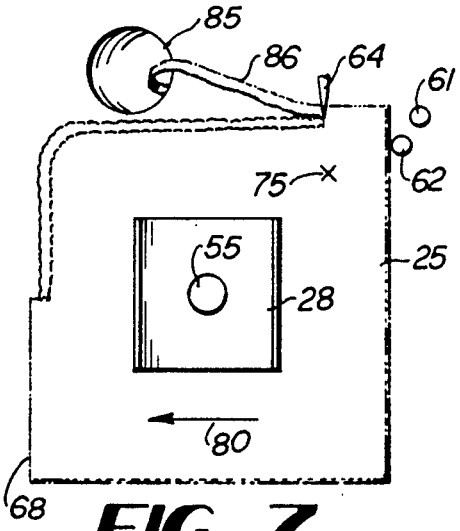
Figure 8:
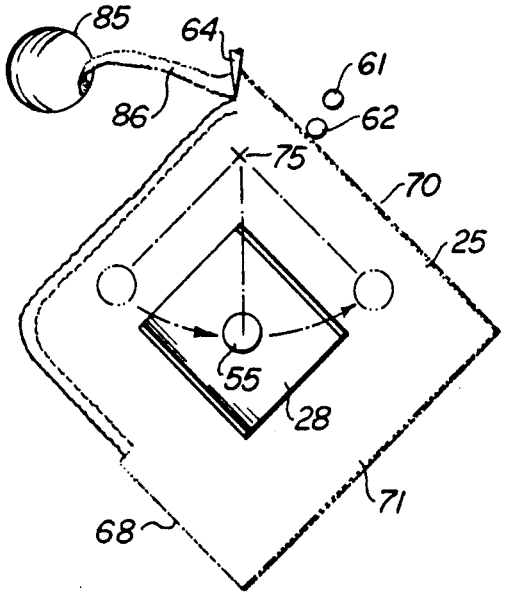
Figure 9:
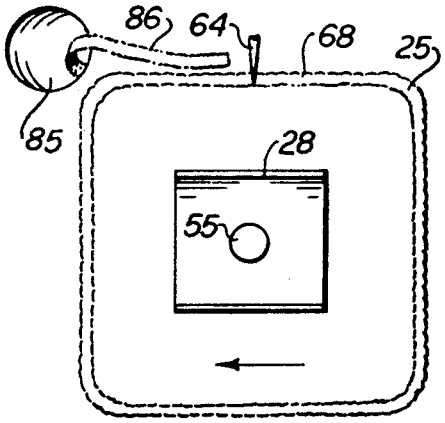
Figure 10:
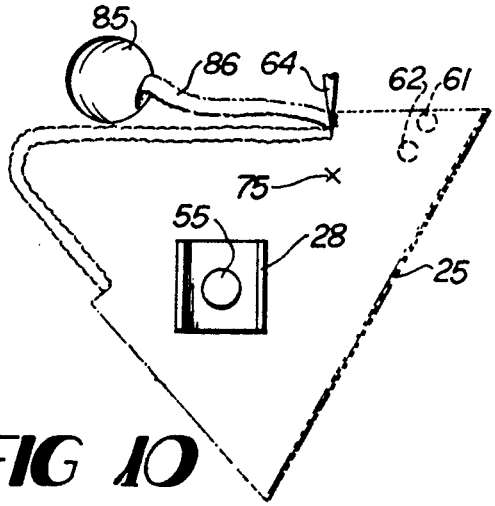
FIG. 10 is a plan view of a non-rectangular work product as it is manipulated adjacent the sewing station.

When the turning function has reoriented the segment 28 as illustrated in FIG. 6 so that its second edge 69 is now approximately parallel to the sewing path 67 of the sewing head 12, the second edge 69 covers first photocell 61. When photocell 61 is covered at the end of the turning function, the control system terminates the rotational movement of the transport plate 38 about the axis of rotation 75, and then the right to left movement of the transport plate 28 is resumed as indicated by arrow 80 (FIG. 6). This causes the second edge 69 of the segment 25 to move along the sewing path 67 through the sewing station 65 where the edge 69 is finished as by trimming and overedging. The right to left movement as indicated in FIG. 6 continues as shown in FIG. 7 until the second photocell 62 is again uncovered, whereupon the segment 25 is again rotated, as illustrated in FIG. 8. Again, the transport plate 28 is rotated about the axis of rotation 75 until the third edge 70 covers first photocell 61, whereupon the rotational movement imparted to the segment 25 by the transport plate 28 is terminated and linear movement resumes. This action is repeated until all of the edges 68–71 have been-finished. As shown in FIG. 9, the segment 25 will have been rotated a full 360 degrees so that the unfinished portion of the first edge 68 can be finished at the end of the finishing operation.

An exhaust port 85 is formed in the work table 11 and is ducted to a vacuum chamber (not shown). This causes the waste material 86 trimmed from the segment 25 to be progressively disposed of and taken away from the vicinity of the work table 11.

When the segment 25 has been finished by trimming and overedging as illustrated in FIG. 9, or by other finishing procedures, the segment is moved by the transport plate 28 and the work product control system 14 to a gap 88 (FIG. 1) in the work table where the segment is permitted to fall to a conveyor or stacker. Obviously, other retrieving and stacking devices can be used, if desired.

The X and Y right angle movements of the transport plate 28 as well as the rotational movement of the transport plate about the axis of rotation 75 are all controlled by the work product control system 14. In the embodiment illustrated herein, the work product control system comprises travel screws and other conventional motors, bearings and supports that function to move the transport plate in the X and Y directions. The motor 68 mounted to travel head 29 functions to rotate transport plate 28, by rotating the cylinder 55 with respect to the travel head 29.

While gravity tends to maintain transport plate 28 and travel head 29 in the upright attitude as illustrated in FIG. 1 guide bars (not shown) can extend through travel head 29 from perimeter travel blocks 35 and 36, if desired, to stabilize the transport plate. Moreover, the work product control system can comprise structural movement apparatus other than the travel screw system disclosed herein, as may be desired for varying conditions.

The software for the computer control system will include X and Y coordinates so that the positions of the transport plate 28 the axis of rotation 75 and the sewing station 65 will be known in the program. The coordinates for the axis of rotation 75 can be changed, and the coordinates for the transport plate 29 will be progressively changed as the transport plate is moved about the work table 11.

While the invention has been described as functioning to finish the edges of a rectangular work product, work products having corners that are not formed as right angles also can be accommodated by the invention. For example, FIG. 10 discloses a triangular shaped work produce which can be handled by the system. Likewise, should the work product be non-symmetrical, the system will function to properly finish its edges. Further, if non-rectilinear edges are present on the work product, the work product control system continually adjusts the work product as it is being finished so as to follow the non-linear edges of the work product.

While the invention has been disclosed as finishing the edges of terry cloth material, it will be understood that the edges of other types of work products can be finished by the system, including other types of textile goods as well as plastics, metals, and various other non-textile products. Also, while an overedge sewing machine has been disclosed as the implement that finished the edges of the work product, other types of edge finishing apparatus can be employed in the system as may be desired.

It will be understood that the foregoing relates only to a preferred embodiment of the present invention, and that numerous changes and modifications may be made therein without departing from the spirit and scope of the invention as set forth in the following claims.

What is claimed is:

1. A method of finishing a segment of sheet material having a plurality of approximately rectilinear edges arranged in series adjacent one another about the perimeter of the segment comprising:

moving the segment toward a sewing path with a first one of the edges of the segment approaching approximately normal to its length toward the sewing path, detecting the first edge of the segment in the sewing path with a first detector as the first edge moves into the sewing path, in response to detecting the first edge moved into the sewing path advancing the segment approximately parallel to its first edge along the sewing path through a sewing station in the sewing path, finishing the first edge of the segment as the first edge advances along the sewing path through the sewing station, detecting an adjacent edge of the segment following the first edge with a second detector positioned out of the sewing path of the first edge of the segment and closer to the sewing station than the first detector as the adjacent edge reaches a predetermined distance from the sewing station, in response to detecting the adjacent edge reaching the predetermined distance from the sewing station turning the segment until the adjacent edge is positioned in and oriented approximately parallel to the sewing path, detecting the adjacent edge of the segment as the adjacent edge becomes positioned in and oriented approximately parallel to the sewing path, in response to detecting the adjacent edge of the segment becoming positioned in and oriented approximately parallel to the sewing path terminating the turning of the segment and advancing the segment with the adjacent edge moving approximately parallel to and along the sewing path and through the sewing station, finishing the adjacent edge of the segment as the adjacent edge advances along the sewing path through the sewing station, and repeating the steps of detecting, turning advancing and finishing of the other adjacent edges of the segment until all of the edges about the perimeter of the segment desired to be finished have been finished.

2. The method of claim 1 and wherein the steps of turning the segment until a following adjacent edge is oriented approximately parallel to the sewing path comprises rotating the segment about an axis displaced from the following adjacent edge a distance substantially equal to a distance from the axis to the edge just finished.

3. The method of claim 2 and wherein the steps of finishing the edge of the segment comprise cutting the segment adjacent and parallel to the edges of the segment to form cut edges, and forming overedge stitching along the cut edges of the segment.

4. A method of finishing a work product having a plurality of approximately rectilinear edges arranged in series adjacent one another about the perimeter of the work product comprising:

moving the work product toward a finishing station with a first edge approaching approximately normal to its length toward the finishing station, detecting the first edge of the work product as the first edge moves into the finishing station, advancing the work product approximately parallel to the first edge along a path through the finishing station, finishing the first edge as the first edge advances through the finishing station, detecting an adjacent edge of the work product following the first edge as the adjacent edge approaches the finishing station, in response to detecting the adjacent edge approaching the finishing station turning the work product until the adjacent edge is oriented approximately parallel to the path, advancing the work product approximately parallel to the adjacent edge along the path at the finishing station, finishing the adjacent edge of the work product as the adjacent edge advances through the finishing station, repeating the steps of detecting, turning, advancing and finishing of the subsequent adjacent edges of the work product until all of the edges of the work product desired to be finished have been finished, and wherein the steps of moving, advancing and turning comprise placing the work product on a work table, moving a transport member down into engagement with the work product, and moving the work product with the transport member about the work table through X and Y axes parallel to the work table and rotating the work product with the transport member about an axis normal to the work table.

5. A segment of sheet material formed by the method of claim 1.

6. The method of claim 1 and wherein the segment is rectangular.

7. The method of claim 1 and wherein the segment is polygonal.

8. The method of claim 1 and wherein the segment is triangular.

9. Apparatus for finishing a work product having a series of edges extending about its perimeter comprising:

a flat horizontal work surface, an edge finishing apparatus positioned adjacent said work surface and defining a path along which an edge of the work product travels when the edge finishing apparatus operates, a transport member, means for moving said transport member toward engagement with the work product positioned on said work surface, linear drive means for moving said transport member in right angle X and Y directions parallel to said work surface, rotary drive means for rotating said transport member about an axis perpendicular to said work surface, first detector means for detecting a first one of the edges of the work product as the work product is moved by said transport means into the path, and second detector means for detecting a next adjacent edge in series about the perimeter of the work product as the next adjacent edge of the work product approaches the edge finishing apparatus, whereby the transport member moves the first edge of the work product on the work surface at the edge finishing apparatus along the path, the edge finishing apparatus finishes the first edge of the work product positioned at the edge finishing apparatus, the second detector means detects the next adjacent edge of the work product moving toward the edge finishing apparatus, and the transport member rotates the work product on the work surface in response to the detection of the next adjacent edge of the work product until the next adjacent edge is detected by the first detector, and the edge finishing apparatus finishes the next adjacent edge of the work product.

10. The apparatus of claim 9 and wherein said sewing machine comprises a sewing needle and said sewing path intersects said needle, said first detector means is positioned in the sewing path and said second detector means is positioned out of the sewing path and closer to the sewing needle than the first detector means, whereby the work product passes beyond the first detector before the work product passes beyond the second detector.

11. A method of finishing a segment of material having a plurality of edges arranged in intersecting series adjacent one another about the perimeter of the segment comprising:

placing the segment with a first edge of the segment in a path extending through a finishing station, detecting with a first detector the placement of the first edge of the segment in the path, in response to detecting with the first detector the first edge of the segment advancing the segment in a direction that moves the first edge of the segment along the path through the finishing station, finishing the first edge of the segment as the first edge of the segment moves through the finishing station, as a second edge of the segment, which is the following adjacent edge in series about the segment from the first edge, approaches the finishing station, detecting with a second detector the second edge of the segment at a position out of the path of and closer to the finishing station than the first detector, in response to detecting with the second detector the second edge of the segment turning the segment about an axis displaced from the finishing station and extending through the segment until the second edge becomes aligned with the path, detecting with the first detector the turning of the second edge into alignment with the path, in response to detecting with the first detector the turning of the second edge into alignment with the path terminating the turning of the segment and advancing the segment in a direction that moves the second edge of the segment along the path and through the finishing station, and finishing the second edge of the segment as the second edge moves through the finishing station.

12. The method of claim 11 and further including repeating the steps of detecting, turning, advancing and finishing until all of the edges about the perimeter of the segment desired to be finished have been finished.

13. The method of claim 11 and wherein the step of placing a segment of sheet material with a first edge in the path extending through a finishing station comprises advancing the segment in a direction approximately normal to its first edge toward the path until the first edge moves into the path.

14. The method of claim 11 and wherein the steps of advancing and turning the segment comprise placing the segment on a work table, moving a transport member into engagement with the segment, moving the segment with the transport member about the work table through X and Y directions parallel to the work table and rotating the segment with the transport member about an axis normal to the work table.

15. The method of claim 11 and wherein the steps of advancing the segment comprise moving the segment in a rectilinear path without turning the segment.

16. A method of finishing a segment of sheet material having a plurality of edges arranged in intersecting series about the perimeter of the segment as the edges of the segment are moved along a path through a finishing station comprising:

aligning a first edge of the segment with the path extending through the finishing station, detecting the first edge of the segment positioned in alignment with the path through the finishing station with a first detector, in response to detecting the first edge with the first detector advancing the segment in a rectilinear direction that moves the first edge of the segment along the path through the finishing station and finishing the first edge at the finishing station until the segment moves beyond the first detector, as the first edge of the segment is being finished and after the segment moves beyond the first detector detecting the second edge in series about the perimeter of the segment with a second detector displaced from the path and positioned closer to the finishing station than the first detector, in response to detecting the second edge with the second detector turning the segment about an axis displaced from the finishing station and extending through the segment until the second edge is turned into alignment with the path and is detected by the first detector, in response to detecting the second edge with first detector terminating the turning of the segment and advancing the segment in a rectilinear direction that moves the second edge of the segment along the path through the finishing station, and finishing the second edge at the finishing station.

17. The method of claim 16 and wherein the steps of advancing the segment in a rectilinear direction comprises moving the segment on a flat work table through a needle position of a sewing machine in the finishing station without turning the segment, and wherein the step of turning the segment about an axis comprises turning the segment about an axis equidistant from the first edge and the second edge of the segment.

18. Apparatus for finishing a segment of sheet material having a series of edges about its perimeter comprising:

a work table, a sewing machine including a sewing needle positioned adjacent said work table and defining a sewing path intersecting the sewing needle, a first detector means positioned in said sewing path, a second detector means positioned out of the sewing path and closer to said needle than said first detector means, a transport member for moving the segment in right angle X and Y directions on said work table and for turning the segment about an axis extending through said work table at a position displaced from the needle, control means responsive to said first and second detector means for turning the segment about said axis in response to the second detector means detecting that the segment is passing beyond said second detector means and advancing the segment along the sewing path in response to the first detector means detecting that an edge of the segment has turned to a position in the sewing path.

19. The apparatus of claim 18 and wherein said first and second detector means comprise light sensing means mounted in said work table.

* * * * *